US005816949A

United States Patent [19]

Dutchburn

[11] Patent Number: 5,816,949

[45] Date of Patent: Oct. 6, 1998

[54] HOCKEY STICK

[76] Inventor: Leslie G. Dutchburn, 7 De Vere Garden, Toronto, Ontario, Canada, M5M 3E4

[21] Appl. No.: 133,294

[22] Filed: Oct. 8, 1993

[51] Int. Cl.[6] ..... A63B 59/14

[52] U.S. Cl. ..... 473/563

[58] Field of Search ..... 273/67

[56] References Cited

U.S. PATENT DOCUMENTS

| | | | |
|---|---|---|---|
| 3,529,825 | 9/1970 | White | 273/67 A |
| 4,343,468 | 8/1982 | Lindgren | 273/67 A |
| 4,491,320 | 1/1985 | Smith | 273/67 A |
| 4,563,006 | 1/1986 | Hollner | 273/67 A |
| 4,799,682 | 1/1989 | Hughes | 273/67 A |

*Primary Examiner*—Mark S. Graham
*Attorney, Agent, or Firm*—David W. Wong

[57] ABSTRACT

The hockey stick is provided with a recess formed at its lower edge of the blade. The recess eliminates ice build up on the front surface of the blade and relieves the air resistance and erratic buffeting of the blade when the latter is swung at a high speed against the puck. The front surface of the blade also slopes upwardly and rearwardly to enhance the release of air resistance build up on the blade. A resilient bumper is provided at the front end of the blade to safeguard against wear and tear of such end as well as minimizing accidental injury to the players hit by the blade.

10 Claims, 2 Drawing Sheets

HOCKEY STICK

BACKGROUND OF THE INVENTION

This invention relates to hockey sticks and particularly to an ice hockey stick used for maneuvering and/or impacting a hockey puck in a hockey game.

A hockey stick for playing a hockey game has a long handle having a play head or blade either formed integrally with the stick handle or mounted to the lower end of the handle. The play-head or blade is used to either push or carry the hockey puck on the ice surface of the hockey ring. The stick can also be used by swinging it at the hockey puck to impact the hockey puck to travel at a high speed for shooting at the goal net in the hockey game. The play-head or blade has a generally rectangular shape with a straight lower edge and a normally truncated front end, or the blade may be curved at its middle portion to provide a hook shape for improving puck handling.

In playing the game, when the hockey stick is used to maneuver the hockey puck, the lower edge of the stick is glided over the ice surface of the hockey ring, such sliding and gliding actions inherently cause ice to be scraped from the ice surface and to become accumulated and adhered onto the surface of the playing front surface of the play head or blade. Such ice accumulation often causes difficulties with the maneuvering of the puck, since the profile of the front surface becomes irregular. Also, when the play-head is swung against the ice surface in shooting the puck-lying on the ice surface, the play-head exerts an immense cutting action at the ice surface which causes more considerable amount of ice to be scooped up by the lower edge of the blade. The large amount of ice also becomes accumulated to the playing front surface to compound the above mentioned problem. Furthermore, when the play-head is swung against the puck when shooting the latter, a considerable air resistance is built up on the play-head surface travelling at such extremely high speed and the air resistance is particularly great when the lower edge comes in intimate contact with the ice surface. The intimate contact does not allow the air resistance to the play-head to dissipate, so that it creates a dragging effect to slow down the swing of the play-head as well as a vibrating or buffeting effect in the play-head. Such dragging and buffeting effects interfere with the maneuvering of the stick, and they contribute to the inaccuracy of the shot.

SUMMARY OF THE INVENTION

The above drawbacks of the hockey stick are alleviated by the present invention.

The principal object of the hockey stick of the present invention is to provide a play-head having means to release the air resistance built up therein when it is swung against the puck.

Another object of the present invention is to provide a play-head which eliminate ice build up on the play surface therein.

Another object of the present invention is to provided a play-head having a resilient bumper to minimize the injury to the player when accidentally hit by the front end of the stick.

It is yet another object of the present invention to provide a hockey stick which is simple in construction yet facilitates the accuracy in the shooting of the puck against the goal net.

Briefly, the hockey stick according to the present invention is provided with a play-head or blade which has a front surface operative for playing and impacting the hockey puck. The front surface has a middle portion with an elongated recess formed in its lower edge. This recess has an elongated inner edge, and the recess operatively forms an elongated gap between the elongated inner edge and the hockey playing surface when the lower edge of the play-head is pushed against the playing surface. The upper portion of the front surface is also sloping upwardly and rearwardly to allow the air resistance to be release from the front surface.

BRIEF DESCRIPTION OF THE DRAWINGS

Other objects of the invention will appear in the following description and appended claims reference being made to the accompanying drawings in which

BRIEF DESCRIPTION OF THE PREFERRED EMBODIMENTS

Figure 1:
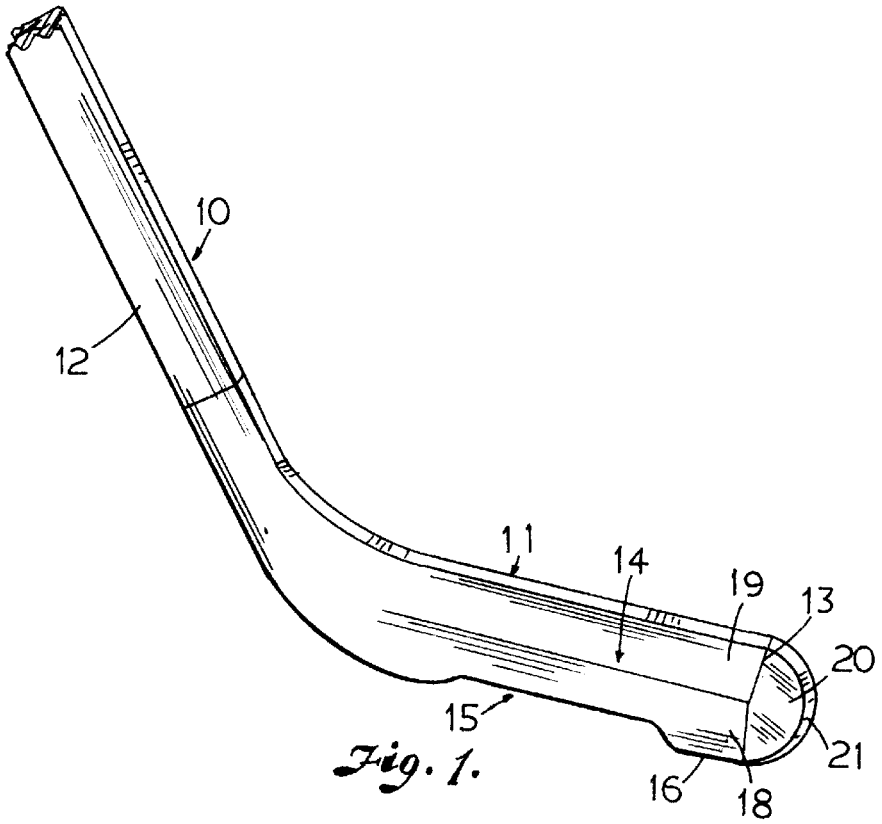
FIG. 1 is a perspective front elevation view of the hockey stick according to the present invention.
Figure 2:
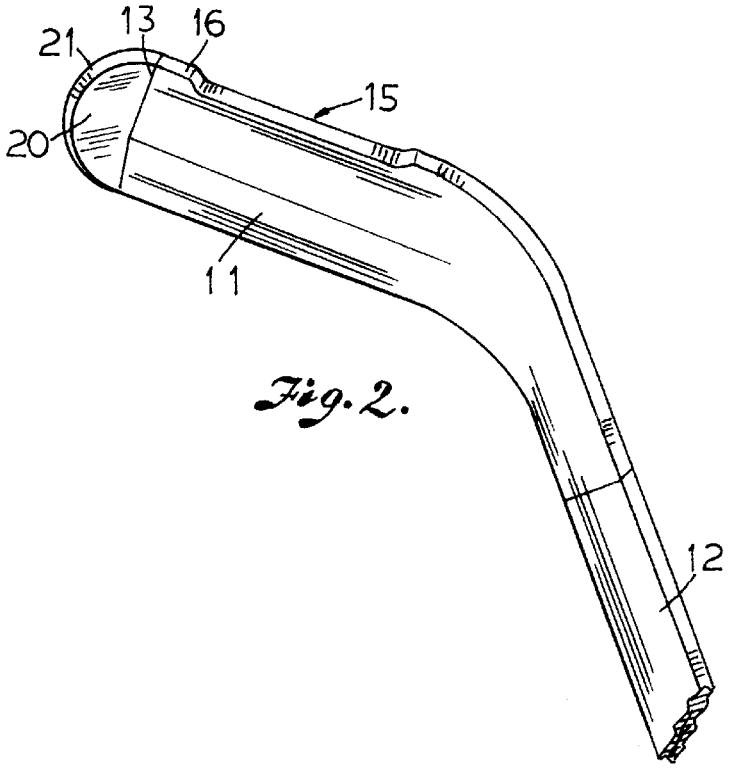
FIG. 2 is a perspective bottom elevation view of the hockey stick showing the provision of the recess therein.
Figure 3:
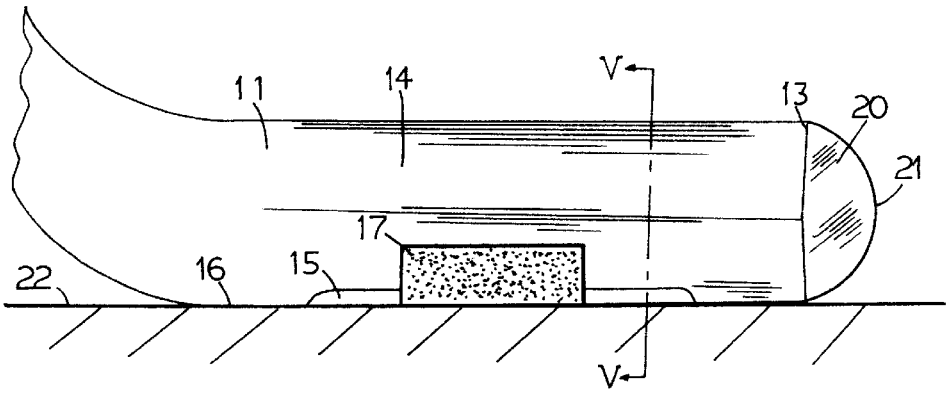
FIG. 3 is a side elevation view of the blade thereof resting on the ice surface with the hockey puck juxtaposed to the front surface of the blade.

With reference to the drawings wherein like reference numerals designate like parts in the several views, the hockey stick 10 according to the present invention has a play head or blade 11 which may be integrally formed on the handle 12 or provided separately which can be mounted to the end of the handle 12 in a well known manner. The blade 11 commonly may either be flat or has a slight curvature curving forward at its middle portion with the front end 13 curving slightly towards the front surface 14.

A recess 15 is formed at the lower edge 16 of the blade 11. The recess 15 is located at the middle portion of the lower edge 16 and may extend about three quarter the entire length of the lower edge 16. It has a height extending inwardly from the lower edge 16 less than the height of a standard hockey puck 17. Typically, the height is about quarter of an inch for a standard hockey blade of about three inches in total height.

The lower portion 18 of the front surface 14 of the blade 11 is generally flat or slightly curved at it middle portion similar to a common hockey stick blade. However, the upper portion 19 slopes upwardly and rearwardly as best shown in the sectional view in FIG. 5. The reason for such sloping surface portion will become apparent in the following description.

A bumper piece 20 may be provided at the front end 13 of the blade 11. The bumper piece 20 is made of a resilient but wear resistant material such as rubber or similar material, and it has an arcuate front end 21. The resilient bumper piece 20 eliminates any rough break away edges or irregular shapes of wood material of the blade 11 that may have developed through wear in the hockey game. Furthermore, it would lessen the injury to the player who may accidentally be hit by the front end of the blade 11. The resilient bumper piece would encourage glancing off and cushioning of any such accidental contact.

Figure 4:
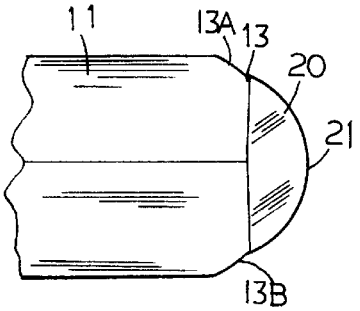
FIG. 4 is an enlarged partial side elevation view of the blade front end having bevelled top and bottom corners.

As best shown in FIG. 4, the front end 13 of the blade 11 may also be provided with bevelled top corner 13A and bevelled bottom corner 13B at a shoulder portion located adjacent to the front end 13 of the blade. Such bevelled corners provide a smooth profile to lessen the accidental injury to the player when hit by the front end of the blade even when the bumper piece 20 is not provided. They can also serve to facilitate the mounting of the bumper piece 20 to the front end of the blade.

Figure 5:
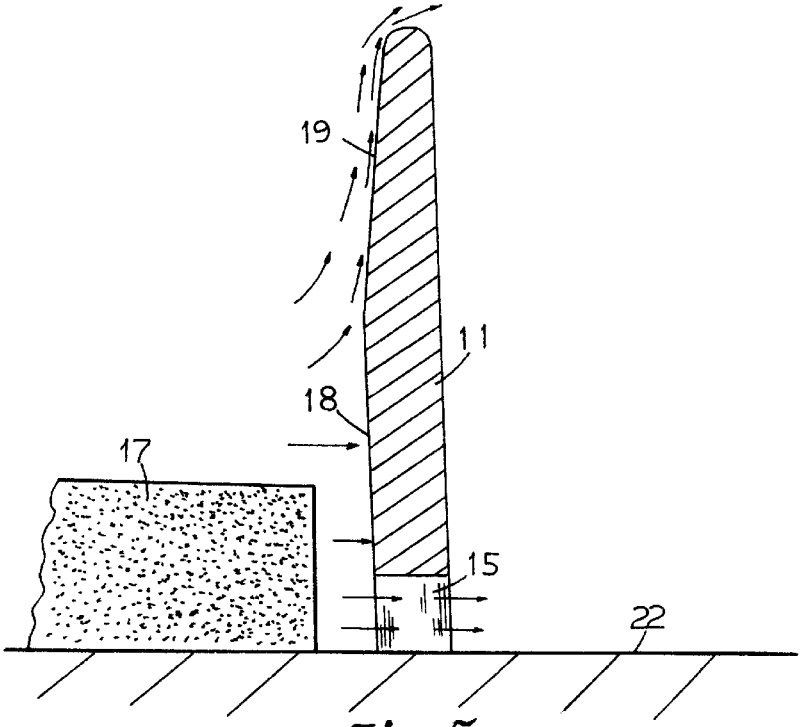
FIG. 5 is an enlarged sectional side view along section line V—V in FIG. 3.

The recess 15 provides several purposes. It allows the snow of the ice surface to pass through the slot opening formed between the ice surface 22 and the recess 15 when the blade 11 is sliding over the ice surface 22. Therefore, ice build up on the front surface 14 of the blade 11 is eliminated. Also, the recess 15 reduces the amount of surface contact between the ice surface 22 and the blade 11 thus reducing surface friction to render quicker handling of the hockey stick. Such quick handling is particularly essential in launching a wrist shot with more power, and facilitates the snapping of the shot with higher accuracy from a face off. Moreover, more importantly it provides a release of the air resistance built up against the blade 11 when the latter is swung quickly at the puck. As best shown in FIG. 5, the air turbulence against the blade 11 travelling at such extremely high speed shown by the arrows will pass through the opening formed between the blade and the ice surface. Also, air resistance is released by glancing off the sloping top portion of the front surface 14. With the large reduction of air resistance, and the elimination of vibration and buffeting of the blade, the player can maneuver the stick more freely and with much higher speed and precision which are extremely essential in playing the game. The above improvements are particularly noticeable with a curved blade, since the air resistance is released by the recess, and is not trapped in the curved pocket formed between the curved blade and the ice surface. The recess continuously relieves turbulence to the blade, thus assuring a smooth, uninterrupted swing of the blade at the puck with a follow through motion to result in a maximum impact power.

Obviously, numerous modifications and variations of the present invention are possible in light of the above teachings. It is therefore to be understood that within the scope the appended claims, the invention may be practiced otherwise than as specifically described in the above exemplary embodiments.

What is claimed is:

1. A play-head for a hockey stick comprising, a generally rectangular body portion having one end adapted to be mounted to a hockey stick handle, a middle portion having a front surface operative for playing and impacting with a hockey puck, said middle portion having an elongated lower edge operative to contact with a play surface of a hockey ring, said lower edge having an elongated recess formed therein, said recess having an elongated inner edge, and said recess operatively forming an elongated gap between said elongated inner edge and said play surface when said lower edge abuts directly against said play surface, said front surface has a substantially flat lower portion and an upper portion sloping upwardly and rearwardly from said lower portion.

2. A play-head for a hockey stick according to claim 1 including bevelled top and bottom corners formed at a shoulder portion located adjacent to a front end of said body portion.

3. A play-head for a hockey stick according to claim 2 wherein said recess has sloping side edges.

4. A play-head for a hockey stick according to claim 3 including a resilient bumper means provided at a front end therein.

5. A play-head for a hockey stick according to claim 4 wherein said bumper means has an arcuate front edge.

6. In a hockey stick for impacting a hockey puck in a hockey game, said stick having a play-head comprising a substantially elongated body portion including a middle portion having a front surface operative for playing and impacting said hockey puck, said middle portion having a lower edge operative to be in direct contact with a play surface for said hockey game, said lower edge having an elongated recess formed therein, said recess having a height less than the height of a hockey puck, and said recess having an elongated inner edge, said recess operatively forming an elongated gap between said elongated inner edge and said play surface when said lower edge abuts directly with said play surface during said hockey game, and said front surface having at least a lower portion operative to dispose substantially vertical to said play surface, said front surface including an upper portion sloping upwardly and rearwardly from said lower portion, and said recess having sloping end edges.

7. A hockey stick according to claim 6 including bevelled top and bottom corners formed at a shoulder portion located adjacent to a front end of said body portion.

8. A hockey stick according to claim 7 wherein said body portion of said play head has a front end and a resilient bumper member is secured to said front end.

9. A hockey stick according to claim 8 wherein said bumper member has an arcuate front edge.

10. A hockey stick according to claim 9 wherein said front end has a bevelled top corner and bevelled bottom corner juxtaposed to said bumper member.

* * * * *